US006128807A

United States Patent [19]

Lim et al.

[11] Patent Number: 6,128,807

[45] Date of Patent: Oct. 10, 2000

[54] REFRIGERATOR WITH A REMOVABLE HINGE PIN

[75] Inventors: Kwang Seung Lim; Jong Su Hwang, both of Suwon, Rep. of Korea

[73] Assignee: Samsung Electronics Co., Ltd., Suwon, Rep. of Korea

[21] Appl. No.: 09/190,217

[22] Filed: Nov. 13, 1998

[30] Foreign Application Priority Data

Nov. 22, 1997 [KR] Rep. of Korea ..... 97-62123

[51] Int. Cl.[7] ..... E05D 7/12

[52] U.S. Cl. ..... 16/266; 16/254; 16/DIG. 43; 312/326

[58] Field of Search ..... 16/254, DIG. 43, 16/266; 49/381; 312/326, 405

[56] References Cited

U.S. PATENT DOCUMENTS

| | | | |
|---|---|---|---|
| 3,689,115 | 9/1972 | Andreini et al. | 16/DIG. 43 |
| 4,185,357 | 1/1980 | Busse | 16/DIG. 43 |
| 5,187,837 | 2/1993 | Gunderson et al. | 49/381 |
| 5,579,606 | 12/1996 | Kim | 312/405 |
| 5,870,801 | 2/1999 | Kim | 312/326 |
| 5,884,366 | 3/1999 | Jeong | 16/382 |
| 5,960,518 | 10/1999 | Jeong | 16/382 |

FOREIGN PATENT DOCUMENTS

| | | | |
|---|---|---|---|
| 812521 | 9/1951 | Germany | 16/DIG. 43 |

OTHER PUBLICATIONS 2,259,946 A, U.K. Patent Application, Mar. 1993.

*Primary Examiner*—Anthony Knight
*Assistant Examiner*—Mark Williams
*Attorney, Agent, or Firm*—Burns, Doane, Swecker & Mathis, L.L.P.

[57] ABSTRACT

Disclosed is a refrigerator having a lower hinge member installed at a lower corner of a body forming a cooling compartment, and an upper hinge bracket installed at an upper corner of the body. The lower hinge member has a lower hinge pin assembled to a lower corner of a door for opening/closing the cooling compartment. A removable pin member is installed on the upper hinge bracket. The pin member has an upper hinge pin assembled to an upper corner of the door. A worker fixes the upper hinge bracket and the lower hinge member to the body, and then assembles the door to the body. Then, he installs the pin member on the upper hinge bracket, whereby the upper part of the door is assembled with the upper hinge pin. Thus, the door can be easily assembled to the body. Further, as the pin member is disassembled from the upper hinge bracket, the door can be disassembled from the body without detaching the upper hinge bracket.

5 Claims, 7 Drawing Sheets

REFRIGERATOR WITH A REMOVABLE HINGE PIN

BACKGROUND OF THE INVENTION

1. Field of the Invention

The present invention relates to a refrigerator having a body for forming a cooling compartment and a door for opening/closing the cooling compartment, and more particularly, to a refrigerator capable of assembling/disassembling the door to/from the body easily, by fixing the door with a removable hinge pin.

2. Prior Art

FIG. 7 is an exploded perspective view of a conventional refrigerator. The refrigerator has a body 101 for forming a freezing compartment 102 and a fresh food compartment 103 which are partitioned from each other by a partitioning wall, and a freezing compartment door 104 and a fresh food compartment door 108 which are respectively installed on front sides of the freezing compartment 102 and the fresh food compartment 103.

The freezing compartment door 104 is comprised of an outer plate 105, an inner plate (not shown) assembled to the inner side of the outer plate 105, and a pair of door caps 106 respectively assembled at the upper and lower parts of the outer plate 105 and the inner plate. The inner space formed by the outer plate 105 and the inner plate is filled up with a heat-insulating material. Hinge recesses 107 are formed at one end of each door cap 106. The fresh food compartment door 108 is, like the freezing compartment door 104, comprised of an outer plate 109, an inner plate (not shown), and door cap 110 having hinge recesses 111, respectively.

Meanwhile, a lower hinge member 113 is installed at the lower right corner of the body 101. The lower hinge member 113 has a hinge pin 114 assembled with the hinge recess 111 formed at the lower side of the fresh food compartment door 108.

A middle hinge member 115 is installed between the freezing compartment 102 and the fresh food compartment 103. The middle hinge member 115 has a pair of hinge pins 117 and 116 assembled with the hinge recess 111 formed at the upper side of the fresh food compartment door 108 and the hinge recess (not shown) formed at the lower side of the freezing compartment door 105 respectively.

An upper hinge member 120 is installed on the upper right corner of the body 101. The upper hinge member 120 is, as shown in FIG. 8, comprised of a fixing part 122 formed with a plurality of screw holes 123, and a support part 124 extended from the fixing part 122.

At a corner of the upper side of the body 101, a plurality of screw holes for fixing the upper hinge member 120 to the body 101 are formed. As screws are assembled to the screw holes of the body 101 through the screw holes 123 of the fixing part 122, the upper hinge member 120 is fixed to the body 101.

Meanwhile, the support part 124 of the upper hinge member 120 has a hinge pin 125 assembled with the hinge recess 107 formed at the upper side of the freezing compartment door 104, and a reinforce member 121 is disposed between the upper hinge member 120 and the body 101.

The freezing compartment door 104 and the fresh food compartment door 108 are assembled to the body 101 as follows.

At first, a worker fixes the lower hinge member 113 to the body 101, and assembles the lower part of the fresh food compartment door 108 with the lower hinge member 113.

Then, he inserts the hinge pin 117 of the middle hinge member 115 to the hinge recess 111 formed at the upper side of the fresh food compartment door 108, and then fixes the middle hinge member 115 to the body 101.

Then, he assembles the lower part of freezing compartment door 104 with the hinge pin 116 of the middle hinge member 115, and inserts the hinge pin 125 of the upper hinge member 120 to the hinge recess. 107 formed at the upper side of the freezing compartment door 104. Then, he fixes the reinforce member 121 and the upper hinge member 120 to the body 101 using a plurality of screws.

As such, the middle hinge member 115 is fixed to the body 101 after it is assembled with the fresh food compartment door 108, and furthermore, the upper hinge member 120 is fixed to the body 101 after it is assembled with the freezing compartment door 104, so it is hard to fix the upper and the middle hinge members 120 and 115.

Moreover, since there is a recent tendency that the refrigerator becomes large-sized more and more, there occurs a case that the doors 104 and 108 have to be disassembled from the body 101 in order to reduce the width of the refrigerator. In particular, if the refrigerator cannot enter a room through a gate of the room since the width thereof is greater than that of the room gate, the worker disassembles the doors 104 and 108 of the refrigerator from the body 101 to reduce the width of the refrigerator, and conveys the refrigerator into the room, and then the worker reassembles the doors 104 and 108 to the body 101.

However, in such a conventional refrigerator, since the hinge members 113, 115 and 120 are firmly fixed to the body 101, it is not easy and requires a lot of pains and time to assemble and disassemble the doors 104 and 108.

SUMMARY OF THE INVENTION

The present invention has been proposed to overcome the above-described problems in the prior art, and accordingly it is the object of the present invention to provide a refrigerator capable of assembling/disassembling the door to/from the body easily without detaching the hinge members fixed to the body.

To achieve the above object, the present invention provides a refrigerator having a body for forming a cooling compartment, and a door for opening/closing the cooling compartment, the refrigerator comprising: a lower hinge member installed at a lower corner of the body, the lower hinge member having a lower hinge pin assembled to a lower corner of the door; an upper hinge bracket installed at an upper corner of the body; and a pin member installed on the upper hinge bracket so as to be removable, the pin member having an upper hinge pin assembled to an upper corner of the door.

The upper hinge bracket has an accommodation hole through which the upper hinge pin passes. The accommodation hole accommodates the upper hinge pin. Furthermore, the upper hinge bracket has an arc-shaped groove formed around the accommodation hole. The groove is formed with a hooking hole at an end thereof. The pin member has an arm extended from the hinge pin along a radial direction thereof. The arm is formed with a hooking protrusion extended therefrom so as to be accommodated in the groove. Thus, the pin member is capable of rotating between a fixing position at which the hooking protrusion is engaged with the hooking hole, and a disassembly position at which the hooking protrusion is positioned at an end opposite to the hooking hole in the groove.

It is preferable that a bottom surface of the groove is tilted so as to ascend from the disassembly position to the fixing position.

The pin member has a knob extended along the radial direction thereof. The upper hinge bracket has an accommodation recess which is recessed along a planar direction thereof. The accommodation recess accommodates the knob while the pin member is positioned at the fixing position.

According to the present invention, it is easy to assemble the doors to the body. Furthermore, the doors can be easily disassembled from the body without detaching the upper hinge bracket from the body.

BRIEF DESCRIPTION OF THE DRAWINGS

The present invention will be better understood and its various objects and advantages will be more fully appreciated from the following description taken in conjunction with the accompanying drawings, in which.

DETAILED DESCRIPTION OF THE PREFERRED EMBODIMENT

Hereinafter, the present invention will be described in detail with reference to the accompanying drawings.

Figure 1:
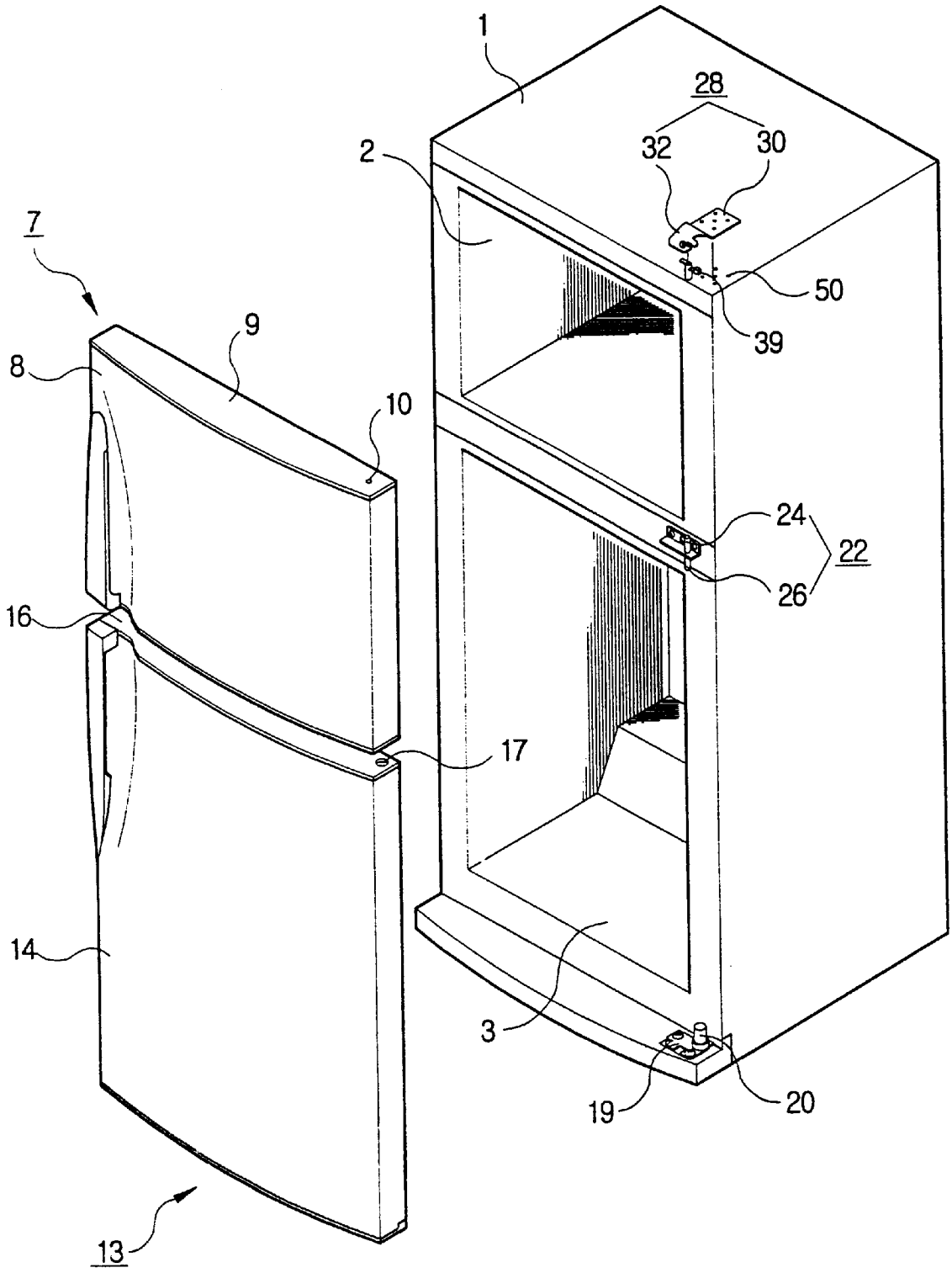
FIG. 1 is an exploded perspective view of a refrigerator according to the present invention.
Figure 2:
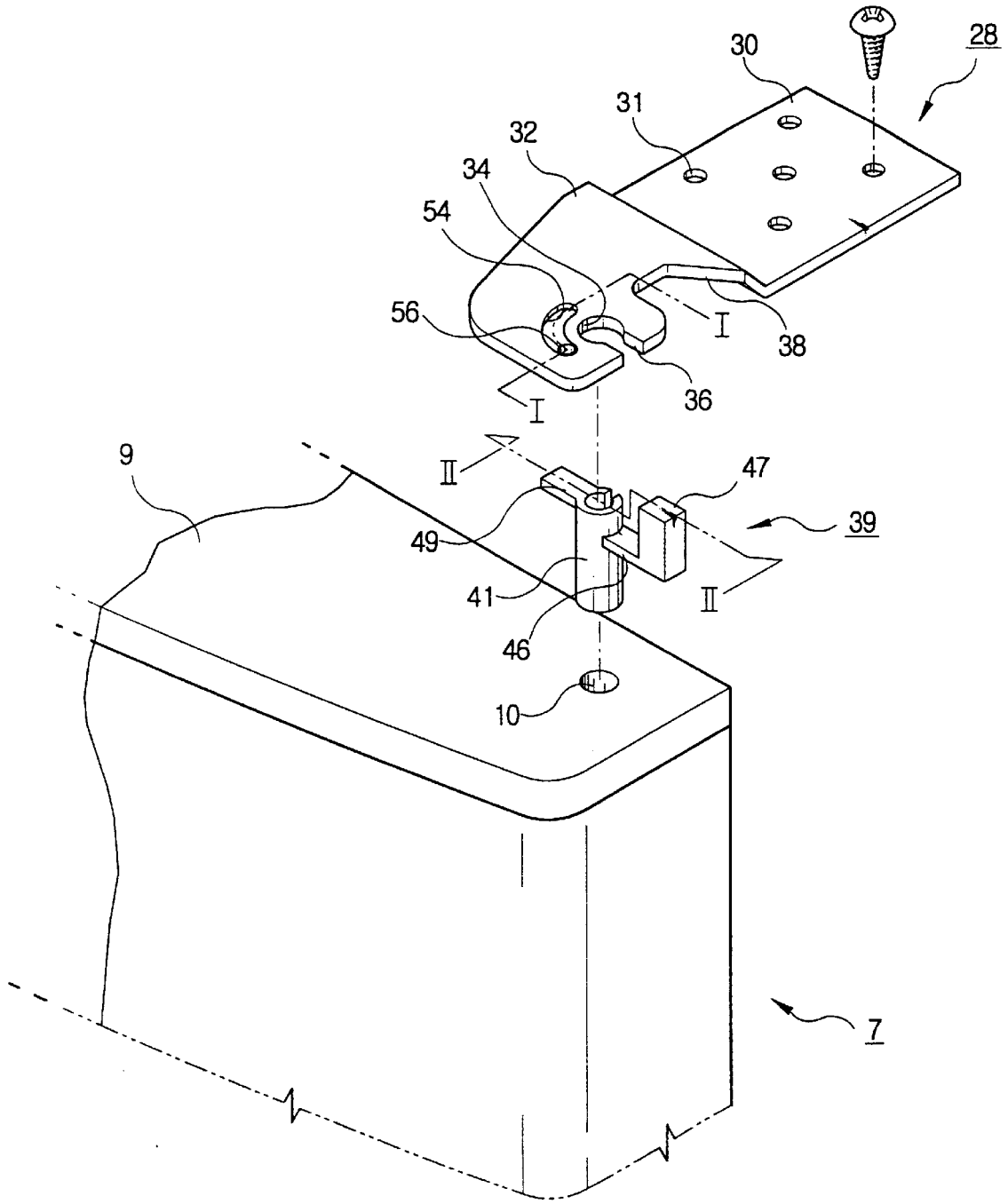
FIG. 2 is a partial enlarged view of FIG. 1.

FIG. 1 is an exploded perspective view of a refrigerator according to the present invention, and FIG. 2 is a partial enlarged view of FIG. 1. The refrigerator according to the present invention has, as the conventional refrigerator, a body 1 for forming a freezing compartment 2 and a fresh food compartment 3 which are partitioned from each other by a partitioning wall, and a freezing compartment door 7 and a fresh food compartment door 13 which are installed on front sides of the freezing compartment 2 and the fresh food compartment 3, respectively.

The freezing compartment door 7 is comprised of an outer plate 8, an inner plate (not shown) assembled to the inner side of the outer plate 8, and a pair of door caps 9 assembled at the upper and lower parts of the outer plate 8 and the inner plate respectively. The inner space formed by the outer plate 8 and the inner plate is filled up with a heat-insulating material. Hinge recesses 10 are formed at one end of each door cap 9. The fresh food compartment door 13 is, like the freezing compartment door 7, comprised of an outer plate 14, an inner plate (not shown), and a pair of door caps 16 having hinge recesses 17 respectively.

Meanwhile, a lower hinge member 19 is installed at the lower right corner of the body 1. The lower hinge member 19 has a hinge pin 20 assembled with the hinge recess (not shown), formed at the lower side of the fresh food compartment door 13.

A middle hinge member 22 is installed between the freezing compartment 2 and the fresh food compartment 3. The middle hinge member 22 has a pair of hinge pins 24 and 26 respectively protruding upward and downward therefrom. Each of the hinge pins 24 and 26 are assembled with the hinge recesses 10 and 17 formed respectively at the lower side of the freezing compartment door 7 and the upper side of the fresh food compartment door 13.

An upper hinge bracket 28 is installed on the upper right corner of the body 1. The upper hinge bracket 28 is, as shown in FIG. 2, comprised of a fixing part 30 formed with a plurality of screw holes 31, and a support part 32 extended from the fixing part 30.

At a corner of the upper surface of the body 1, a plurality of screw holes 50 for fixing the upper hinge bracket 28 to the body 1 are formed. As screws are assembled with the screw holes 50 of the body 1 through the screw holes 31 of the fixing part 30, the upper hinge bracket 28 is fixed to the body 1.

The support part 32 of the upper hinge member 28 has an accommodation hole 34 for accommodating the hinge pin 41 of the pin member 39 which will be described later. Further, a side of the accommodation hole 34 is cut away so that the accommodation hole 34 is extended to an edge of the support part 32, and the extended part provides a passage part 36 through which the second arm 46 of the pin member 39 described later passes.

Figure 4:
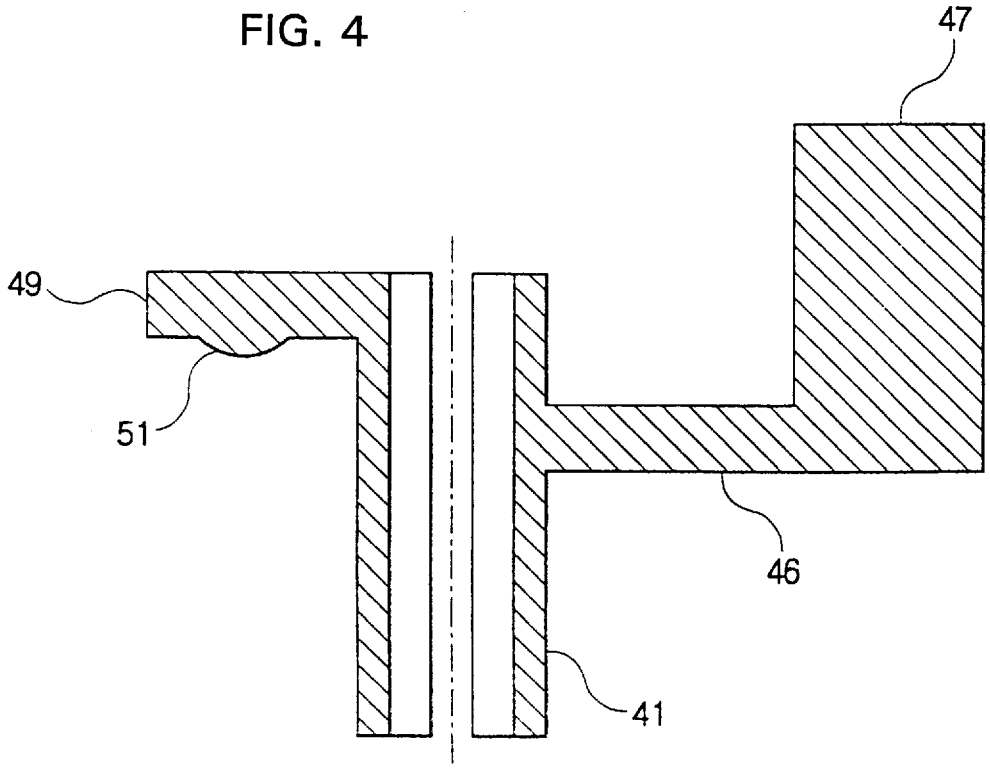
FIG. 4 is an enlarged sectional view of FIG. 2 taken along the line II—II.

The pin member 39 has, as shown in FIGS. 2 and 4, a hinge pin 41 inserted into the accommodation hole 34, and a pair of arms 49 and 46 extended from the hinge pin 41 along the radial direction thereof. The first arm 49 and the second arm 46 are extended oppositely to each other. The first arm 49 is formed at the upper end of the hinge pin 41, and the second arm 46 is formed at a position somewhat lower than the first arm 49.

When the hinge pin 41 is inserted into the accommodation hole 34, the second arm 46 is positioned under the support part 32, and the first arm 46 is positioned over the support part 32. Furthermore, a hooking protrusion 51 protruding downward is formed at the end of the first arm 49, and a knob 47 for rotating the hinge pin 41 is formed at the end of the second arm 46.

Figure 3:
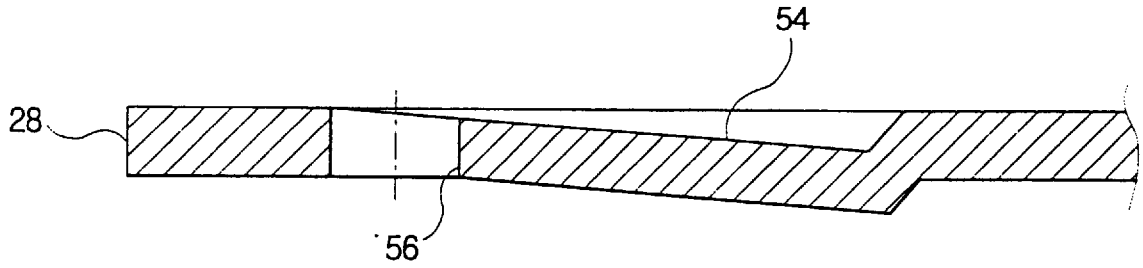
FIG. 3 is an enlarged sectional view of FIG. 2 taken along the line I—I.

The support part 32 has an arc-shaped groove 54 formed around the accommodation hole 34. A hooking hole 56 engaged with the hooking protrusion 51 of the pin member 39 is formed at one end of the groove 54. While the hinge pin 41 is inserted into the accommodation hole 34, the pin member 39 is capable of rotating between a fixing position at which the hooking protrusion 51 is engaged with the hooking hole 56, and a disassembly position at which the hooking protrusion 51 is positioned at an end opposite to the hooking hole 56 in the groove 54. The bottom surface of the groove 54 is, as shown in FIG. 3, tilted so as to ascend from the disassembly position to the fixing position.

Figure 5:
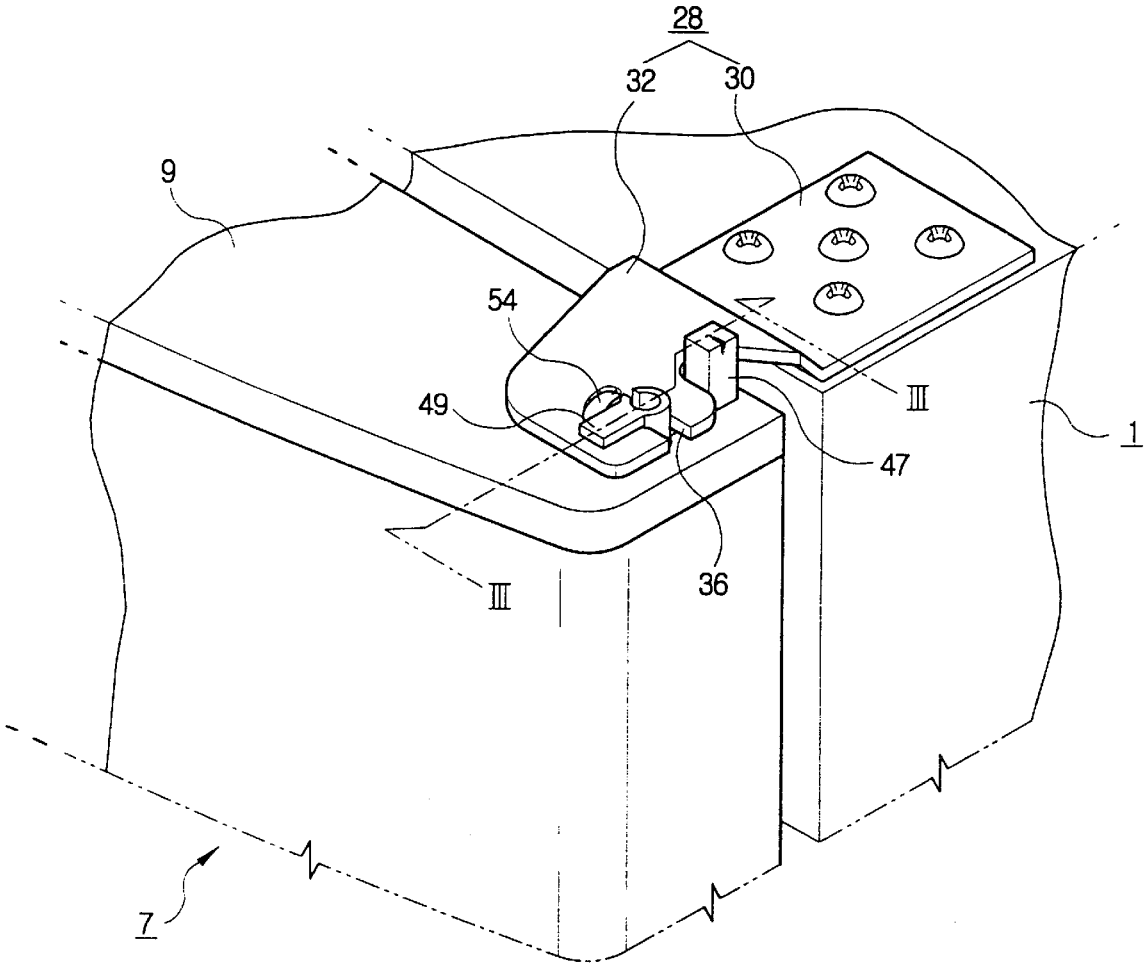
FIG. 5 is a perspective view of the assembled state of FIG. 2.
Figure 6:
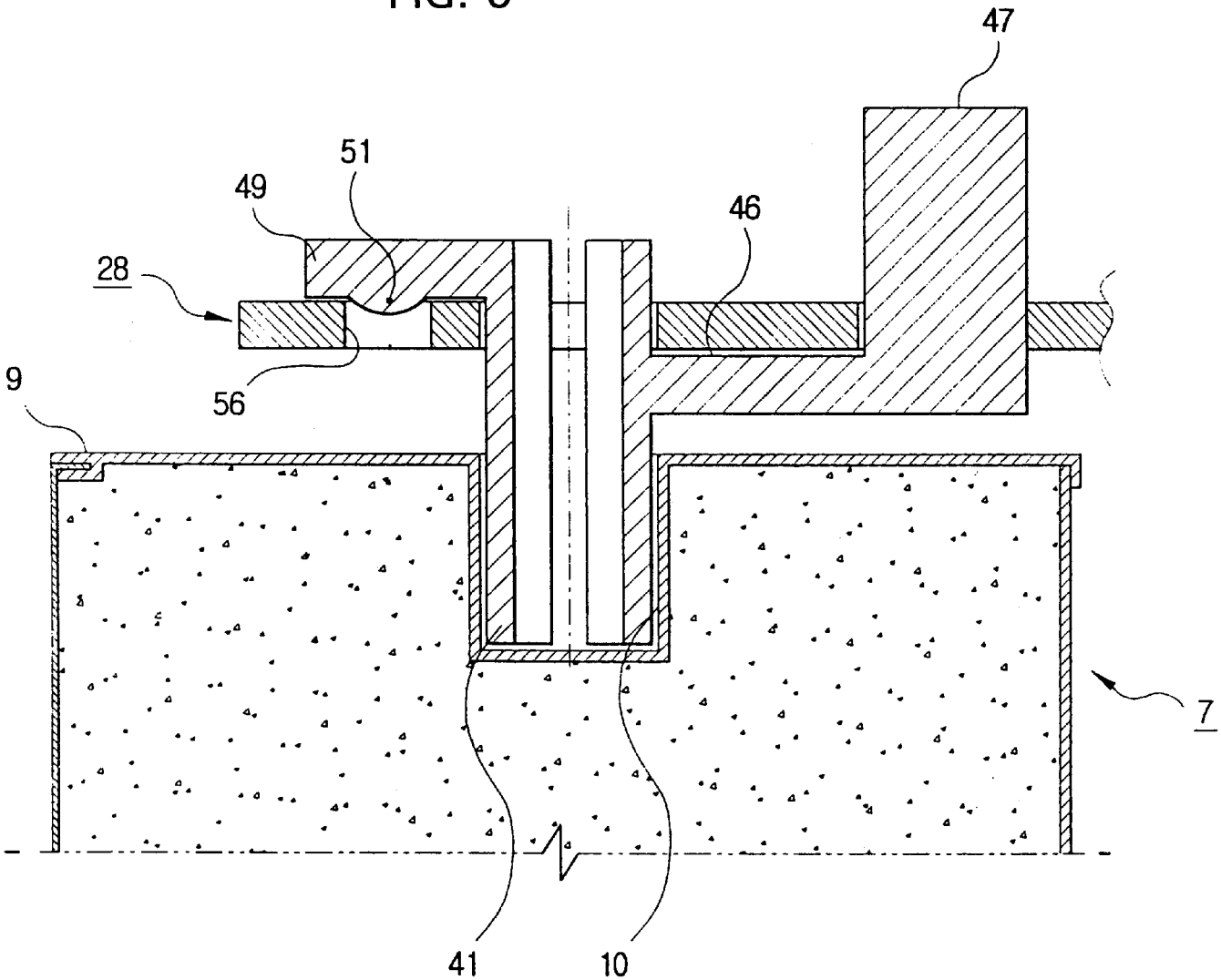
FIG. 6 is an enlarged sectional view of FIG. 5 taken along the line III—III.
Figure 7:
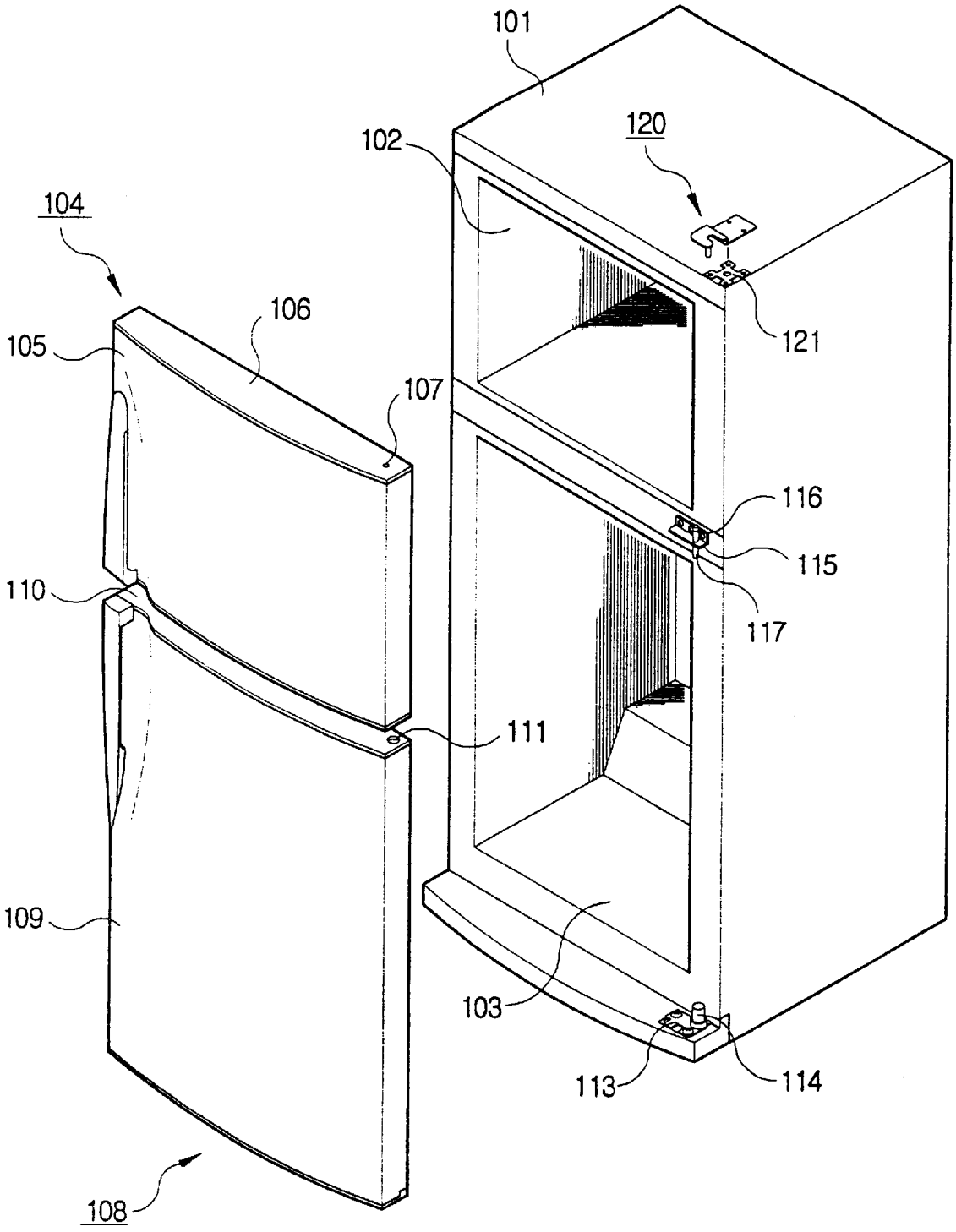
FIG. 7 (PRIOR ART)
FIG. 7 is an exploded perspective view of a conventional refrigerator.
Figure 8:
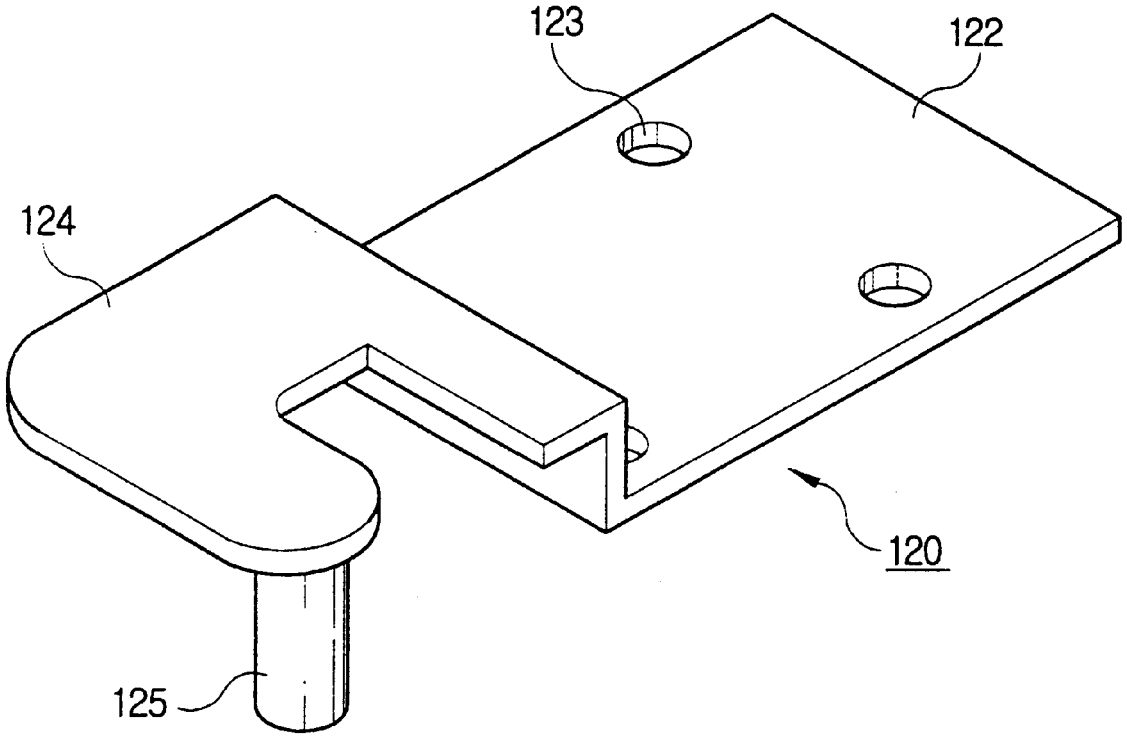
FIG. 8 (PRIOR ART)
FIG. 8 is an enlarged perspective view of the upper hinge member shown in FIG. 7.

Furthermore, the support part 32 is formed with an accommodation recess 38 which is recessed along the planar direction thereof. As shown in FIG. 5, the accommodation recess 38 accommodates the knob 47 while the hinge pin 41 is rotated so as to be positioned at the fixing position, and it also functions to prevent a further rotation of the knob 47.

Hereinbelow, the process for assembling and disassembling the doors in the refrigerator according to the present invention having the above-described construction will be described.

At first, in order to assemble the doors 7 and 13 to the body 1, a worker fixes the lower hinge member 19 and the upper hinge bracket 28 to the body 1 using a plurality of screws, and assembles the lower part of the fresh food compartment door 13 with the lower hinge member 19.

Then, he inserts the hinge pin 26 of the middle hinge member 22 to the hinge recess 17 formed at the upper side of the fresh food compartment door 13, and then fixes the middle hinge member 22 to the body 1.

Then, he assembles the lower part of freezing compartment door 7 with the hinge pin 24 of the middle hinge member 22, and inserts the hinge pin 41 of the pin member 39 into the accommodation hole 34 of the upper hinge bracket 28 so that the hinge pin 41 is assembled with the hinge recess 10 formed at the upper side of the freezing compartment door 7. When the hinge pin 41 is inserted into the accommodation hole 34, the first arm 49 is positioned over the support part 32, and the second arm 46 is positioned under the support part 32 through the passage part 36. In such a situation, the hooking protrusion 51 of the first arm 49 is accommodated in the groove 54, and thereby the pin member 39 is positioned at the disassembly position.

The worker rotates the knob 47 into the accommodation recess 38. Then, the hooking protrusion 51 is moved along the groove 54, and the first arm 49 is elastically curved by the contact between the hooking protrusion 51 and the bottom surface of the groove 54 tilted upward. As the knob 47 is maximally rotated so as to be accommodated in the accommodation recess 38, the hooking protrusion 51 is engaged with the hooking hole 56, whereby the pin member 39 is positioned at the fixing position. At the fixing position, the rotation of the pin member 39 is prevented by the hooking protrusion 51 engaged with the hooking hole 56.

As such, since the doors 7 and 13 are assembled to the body 1 after the upper hinge bracket 28 and the lower hinge member 19 has been firmly fixed to the body 1, it is easy to assemble the doors 7 and 13.

When the case that the width of the refrigerator has to be narrowed occurs while the refrigerator is being conveyed, the freezing compartment door 7 and the fresh food compartment door 13 are disassembled according to the order reverse to the above-described order. That is, the worker operates the knob 47 so that the pin member 39 is rotated toward the disassembly position. Then, the hooking protrusion 51 is separated from the hooking hole 56 and is moved toward the opposite end. Then, the worker moves the pin member 39 upward so as to release the freezing compartment door 7 from the hinge pin 41, and disassembles the freezing compartment door 7 from the body 1. Then, he disassembles the middle hinge member 22 from the body 1 so as to disassemble the fresh food compartment door 13.

According to such a process, the doors 7 and 13 are disassembled from the body 1 easily without detaching the upper hinge bracket 28 firmly attached to the body 1, and the width of the refrigerator is effectively reduced. When the conveyance of the refrigerator has been completed, the doors 7 and 13 are assembled to the body 1 again according to the above-described process.

In the present embodiment, the example is shown that the upper hinge bracket 28 and the pin member 39 according to the present invention is adopted to the freezing compartment door 7, however, an additional hinge bracket having the construction identical to the upper hinge bracket 28 can be adopted to the fresh food compartment door 13.

As described above, according to the present invention, the doors 7 and 13 can be easily assembled to the body 1, and furthermore, the doors 7 and 13 can be easily disassembled from the body 1 without detaching the upper hinge bracket 28 firmly attached to the body 1.

Although the present invention has been described and illustrated in detail, it is clearly understood that the same is by way of illustration and example only and is not to be taken by way of limitation, wherein the spirit and scope of the present invention is limited only by the terms of the appended claims.

What is claimed is:

1. A refrigerator having a body for forming a cooling compartment, and a door for opening/closing said cooling compartment, said refrigerator comprising:

a lower hinge member installed at a lower corner of said body, said lower hinge member having a lower hinge pin assembled to a lower corner of said door;

an upper hinge bracket installed at an upper corner of said body, having an accommodation hole through which said upper hinge pin passes and an arc-shaped groove formed around said accommodation hole, said groove being formed with a hooking hole at an end thereof;

a pin member installed on said upper hinge bracket so as to be removable, said pin member having an upper hinge pin assembled to an upper corner of said door and an arm extended from said upper hinge pin along a radial direction thereof, said arm being formed with a hooking protrusion extended therefrom so as to be accommodated in said groove.

2. The refrigerator as claimed in claim 1, wherein said pin member is capable of rotating between a fixing position at which said hooking protrusion is engaged with said hooking hole, and a disassembly position at which said hooking protrusion is positioned at an end opposite to said hooking hole.

3. The refrigerator as claimed in claim 2, wherein a bottom surface of said groove is tilted so as to ascend from said disassembly position to said fixing position.

4. The refrigerator as claimed in claim 2, wherein said pin member has a knob extended along the radial direction thereof.

5. The refrigerator as claimed in claim 4, wherein said upper hinge bracket has an accommodation recess which is recessed along a planar direction thereof, said accommodation recess for accommodating said knob while said pin member is positioned at said fixing position.

* * * * *